US007232038B2

(12) United States Patent
Whitney

(10) Patent No.: US 7,232,038 B2
(45) Date of Patent: Jun. 19, 2007

(54) DISPOSABLE TEST TUBE RACK

(76) Inventor: Steven G. Whitney, 234 Glenview Rd., Glenview, IL (US) 60025

( * ) Notice: Subject to any disclaimer, the term of this patent is extended or adjusted under 35 U.S.C. 154(b) by 133 days.

(21) Appl. No.: 10/832,728

(22) Filed: Apr. 27, 2004

(65) Prior Publication Data

US 2005/0236346 A1 Oct. 27, 2005

(51) Int. Cl.
*A47B 73/00* (2006.01)

(52) U.S. Cl. ..... 211/74; 211/85.18

(58) Field of Classification Search ..... 211/74, 211/85, 85.18, 85.13; 422/104, 99; 206/499, 206/486, 505–509, 443, 446, 562, 563, 504
See application file for complete search history.

(56) References Cited

U.S. PATENT DOCUMENTS 3,643,812 A * 2/1972 Mander et al. ..... 211/74
4,008,543 A * 2/1977 Vilt ..... 47/1.01 R
4,160,803 A * 7/1979 Potts ..... 422/101
4,284,603 A * 8/1981 Korom ..... 422/101
4,495,150 A * 1/1985 Cook et al. ..... 422/99
4,963,493 A * 10/1990 Daftsios ..... 422/104
5,996,818 A * 12/1999 Boje et al. ..... 211/74
6,436,351 B1 * 8/2002 Gubernator et al. ..... 422/102
6,514,750 B2 * 2/2003 Bordenkircher et al. . 435/286.2
6,568,544 B1 * 5/2003 Lafond et al. ..... 211/74
6,610,252 B2 * 8/2003 Madril et al. ..... 422/99
6,640,981 B2 * 11/2003 Lafond et al. ..... 211/74
6,660,232 B1 * 12/2003 Krueger et al. ..... 422/102
6,675,974 B2 * 1/2004 Ballin et al. ..... 210/477
6,685,036 B2 * 2/2004 de Jenlis et al. ..... 211/59.4
6,783,732 B2 * 8/2004 Madden et al. ..... 422/63
2002/0170867 A1 * 11/2002 Liu ..... 211/74
2003/0215956 A1 * 11/2003 Reed ..... 436/174

* cited by examiner

*Primary Examiner*—Jennifer E. Novosad

(57) ABSTRACT

A test tube rack for supporting, storing and carrying a plurality of test tubes in a laboratory environment comprising a tray, a central support panel and/or lower support panel and a cover. The tray and cover are identical and interchangeable, and tapered for storage in nested stacks. Wells in the tray bottom are in alignment with corresponding openings in the central support panel and corresponding holes in the lower support panel and with domes in the cover, and serve to locate and retain test tubes within the test tube rack. The cover snap-attaches to the tray with at least one molded-in tab on the tray or cover which is received and frictionally retained by a corresponding well on the opposite element, thereby locating and securing the cover to the tray, and also locating and securing the central support panel between the tray and the cover. A dual-purpose support panel has manually removable perforated edges allowing it to serve either as a central support panel or, with the perforated edges removed, as a lower support panel. The test tube rack is preferably made of transparent injection-molded or thermoformed plastic.

5 Claims, 6 Drawing Sheets

DISPOSABLE TEST TUBE RACK

FIELD OF THE INVENTION

This invention relates to improvements in an inexpensive disposable test tube rack suitable for safely storing and carrying a plurality of test tubes, or other axially elongated articles, in supported, separated, upstanding relationship to each other.

BACKGROUND OF THE INVENTION

In a laboratory environment, particularly in laboratories working with biologically active materials, it is important to have a secure means of supporting an array of test tubes, often in a predetermined order, and of transporting and storing them between uses. Among the desirable features in such a product are: transparency, so that the test tubes and their contents are readily visible; nestability, so that the parts of the test tube rack may be compactly nested when not in use; stackability, so that assembled test tube racks may be stacked one on top of the other for storage; and disposability, so that a rack containing a group of used test tubes may be disposed of as a unit, thereby avoiding the need to remove the tubes individually and the need to clean and sterilize the test tube rack for re-use.

To accomplish at least some of the above purposes, a number of devices are disclosed by the prior art, including the following.

Delair U.S. Pat. No. 3,184,071 (May 18, 1965) discloses an injection-molded plastic case for various kinds of containers, including glass containers, in which the principal embodiment has both a central perforated rack and a similarly perforated cover to give two levels of support to hold the containers in an upright position.

Mander, et al. U.S. Pat. No. 3,643,812 (Feb. 22, 1972) shows a storage rack intended specifically for test tubes. It incorporates a base unit and a cooperating cover unit, both made of vacuum-formed thermoplastic such as polypropylene, in which the base unit is a one-piece deep-drawn bucket shape having at its bottom a plurality of evenly spaced tetrahedron-shaped wells, each adapted to receive and support an individual test tube. A drain opening is provided at the bottom of each well to permit condensate to escape.

Korum U.S. Pat. No. 4,284,603 (Aug. 18, 1981) discloses a three-piece test tube rack, open at the sides, in which the component parts may be stored separately and then snapped together for use. The top component has clear-through openings allowing the test tubes to be inserted; the middle component has corresponding clear-through openings for center support; and the base component has semi-closed wells instead of clear-through openings to prevent the test tubes from falling out while still allowing drainage. The base and cover are therefore of necessity not identical, although the specification suggests that the base and cover can be produced using the same mold (col. 3, lines 1-3). Clearly a separate supply of both tops and bases would have to be kept on hand in order to use the device at all, which is a problem solved by the present invention.

Mehra U.S. Pat. No. 4,588,095 (May 13, 1986) shows a complex one-piece injection molded test tube rack having perforated wells at the bottom, and grids for the middle and top supports. The claimed invention resides in the device as a single integral piece, distinguishing it from multi-component units which allow compact nested storage prior to assembly for use, as with the present invention.

SUMMARY OF THE INVENTION

It is therefore a principal object of the invention to provide an improved test tube rack and covered container, made of inexpensive injection-molded or thermoformed plastic, such as PVC (polyvinyl chloride) (utility and virgin), rPVC (recycled polyvinyl choride), and rPET (recycled polyethylene terapthalate), or other materials, for instance polystyrene (PS) or polycarbonate (PC). The ideal material of these is rPVC, although it is more expensive. These plastics can be made in transparent form to readily allow inspection and observation of the container's contents.

Another object of the invention is to provide such a container comprising only three or four parts, comprising a tray, a cover, a central support panel and/or a lower support panel, of which two (the tray and cover) are identical shells. The assembled test tube rack has sufficient depth to accommodate test tubes, or other axially elongated articles, of varying height, while the central support panel and the lower support panel provide positive positioning and support to each test tube or article, to prevent tipping and spilling during shipping and handling. A related object is to provide such a container in which the identical shells (the tray and the cover) are nestable, for compact and convenient storage, and to reduce the total number of different components which a laboratory must keep on hand. Alternatively, a tray may be utilized without a cover, in applications where the cover is not needed.

As a further object of the invention, the identical tray and cover shells are provided at their adjoining flanges with cooperating tabs and depressions which allow the trays and covers to be snapped together (either with or without the central support panel sandwiched between them) to positively hold the test tube rack together, thereby preventing inadvertent tipping and sliding of its contents.

Another desirable feature of the invention is that when a technician is finished with a batch of test tubes in a certain tray, the batch of test tubes may be disposed of as a unit merely by snapping a cover over them to prevent tipping and spilling as they are taken to a disposal point such as a biohazard trash can or sharps container.

A BRIEF DESCRIPTION OF THE DRAWINGS

DETAILED DESCRIPTION OF THE INVENTION

A First Preferred Embodiment

Figure 1:
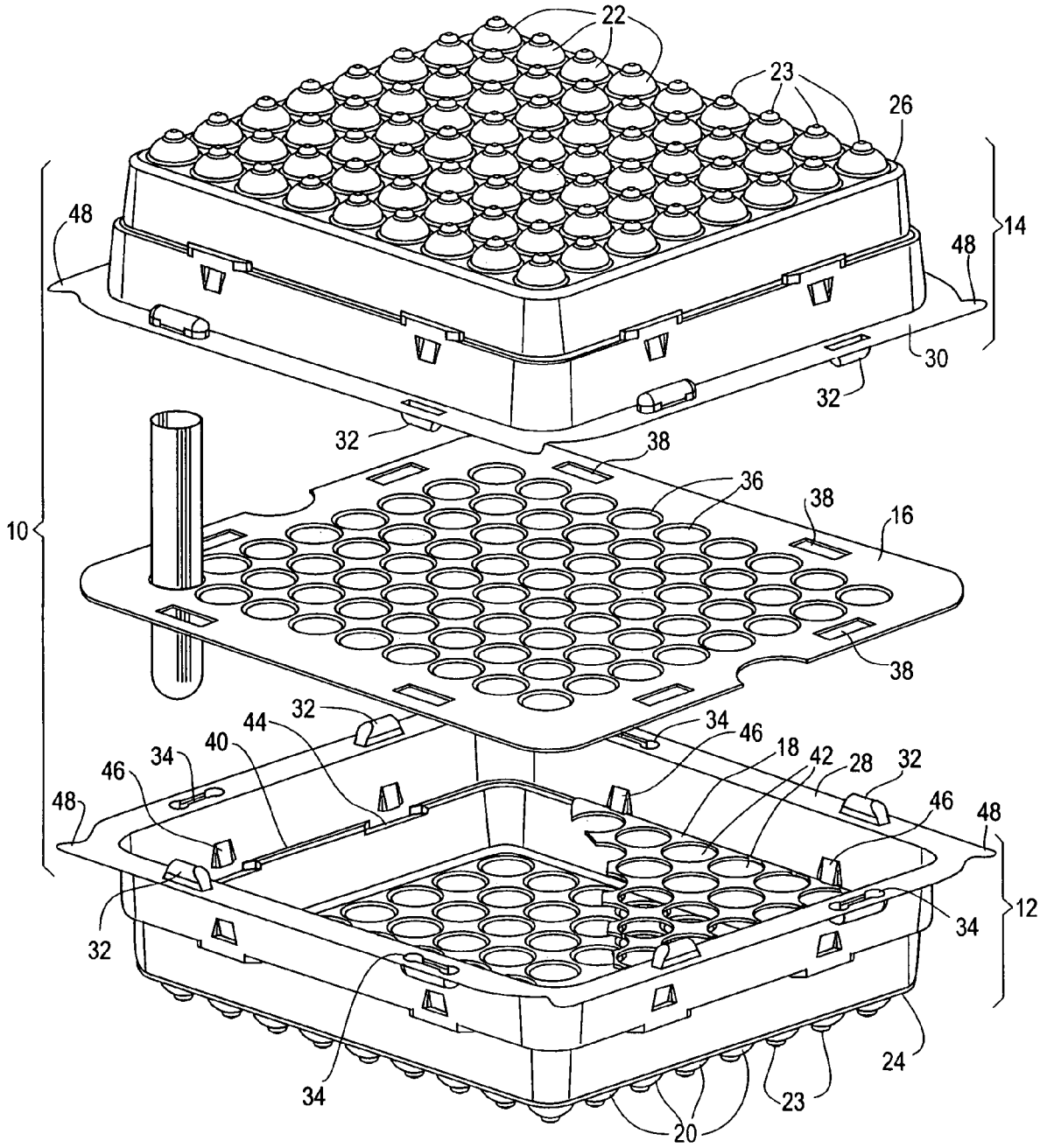
FIG. 1 is an exploded perspective view of the first preferred embodiment of improved test tube rack showing the lower shell, upper shell or cover, central support panel, and lower support panel (partially cut away) resting on a ledge within the lower shell.
Figure 2:
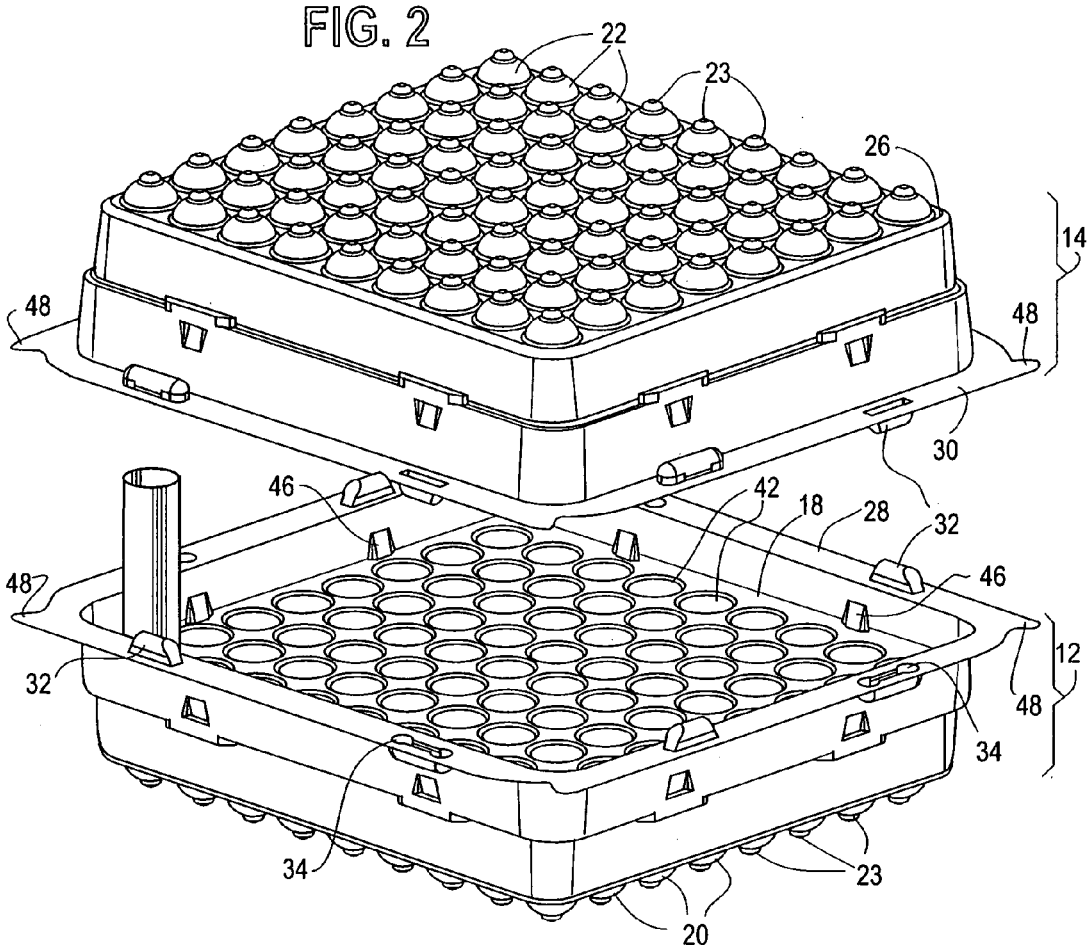
FIG. 2 is an exploded perspective view of the first preferred embodiment of the improved test tube rack showing only the lower support panel in place. The central support panel is not shown.

Turning to the drawings, FIGS. 1-5 show the first preferred embodiment of the improved test tube rack. FIG. 1 shows an exploded view of the four components of the first preferred embodiment of the improved test tube rack 10 comprising a first shell serving as a tray 12, a second shell serving as a cover 14, the central support panel 16, and the lower support panel 18.

The first and second shells are identical pieces and form the tray 12 and the cover 14. The tray 12 and the cover 14 each have an array of hemispherical protrusions corresponding to the positions of the test tubes to be contained within. As a tray 12, the protrusions become wells 20 to cradle and position the test tubes. As a cover 14, the protrusions become domes 22, which fit over, and thereby position, a test tube long enough to touch at both the top of the cover 14 and the bottom of the tray 12. The wells 20 and domes 22 also have an additional protrusion forming a pocket 23 which, when the shell is a tray 12, serves on the inside of the test tube rack to catch spilled material from the test tubes, and also, on the outside of the test tube rack, to provide a cushion between the test tubes and a hard surface onto which a technician might place a filled test tube rack. The pockets 23 serve as a measure of protection against breakage of the test tubes within the test tube rack.

According to the invention, the tray 12 and cover 14 are identical in shape, and can be formed in the same mold. The tray 12 has side walls and end walls to define a rectangular opening and also has a tray bottom 24. Each cover 14 has side walls and end walls to define a second rectangular opening and each cover 14 has a cover top 26. Because the rectangular opening of each tray 12 and cover 14 is larger than the corresponding bottom 24 or top 26, the shells have a taper, which makes them nestable, one inside the other, for compact and convenient storage.

A peripheral tray flange 28 is located around the rectangular opening of the tray 12 and a peripheral cover flange 30 is located around the second rectangular opening of the cover 14. The peripheral tray flange 28 and the peripheral cover flange 30 each include cooperating tab-and-depression positioning units A molded-in protruding tab 32 on one side of the tray 12 is received and retained by a molded-in recessed depression 34 on the facing side of the cover 14, so that the tray 12 and cover 14 may be frictionally attached and retained simply by pressing them together. By forming the tabs 32 at opposite sides of the tray 12 and cover 14, and the depressions 34 at the other sides, the same shell may be used for both tray 12 and cover 14, because they will mate together when a tray 12 is snapped to a cover 14.

The central support panel 16 contains openings 36 which are in alignment with the wells 20 in the tray 12 and the domes 22 in the cover 14 and serve to support the test tubes in the test tube rack. The central support panel 16 also has aligning openings 38 which are in alignment with the tabs 32 and the depressions 34. The tabs 32 protrude through the aligning openings 38 and align over the depressions 34 and serve to secure the central support panel 16 in place on top of the peripheral tray flange 28. When the cover 14 is added, the tabs 32 of the cover 14 protrude through the aligning openings 38 further fixing the central support panel 16 in place as the tray 14 and cover 12 frictionally lock together as described above.

When a tray 12 and cover 14 have been snapped together, the assembled test tube rack may be stacked on top of another assembled test tube rack by placing one on top of the other and positioning the wells 20 of the upper test tube rack on the cover top 26 between the domes of the lower test tube rack. This stackability of the test tube racks is convenient for storing assembled test tube racks on the lab bench on in the refrigerator.

As a further feature of the first preferred embodiment of the invention, a peripheral ledge 40, located on the inside of the side walls and end walls and around the perimeter of the shell located at approximately the midpoint of the height of the shell, holds the lower support panel 18. The lower support panel 18 has holes 42, which are akin to the openings 36 in the central support panel 16, and serve to support the test tubes in the test tube rack. The lower support panel 18 may be used with or without the central support panel 16. Similarly, the central support panel 16 may be used with or without the lower support panel 18. Using both the central support panel 16 and the lower support panel 18 together provides additional support which may be required for taller test tubes. Use of the lower support panel 18 alone without the central support panel 16 in place works well for smaller test tubes.

Also, preferably, the peripheral ledge 40 has grooves 44 spaced around its perimeter, ideally one or two per side of a shell. Trapezoidal shaped nibs 46 located on the inside of the side walls and end walls above the peripheral ledge 40 and aligned over the grooves 44 serve to connectively engage and secure the lower support panel 18 in snap-in relationship. The grooves 44 provide a space below the peripheral ledge 40 so that the lower support panel 18 can be pushed down vertically as it is snapped into place and secured under the nib 46 and on top of the peripheral ledge 40.

Figure 3:
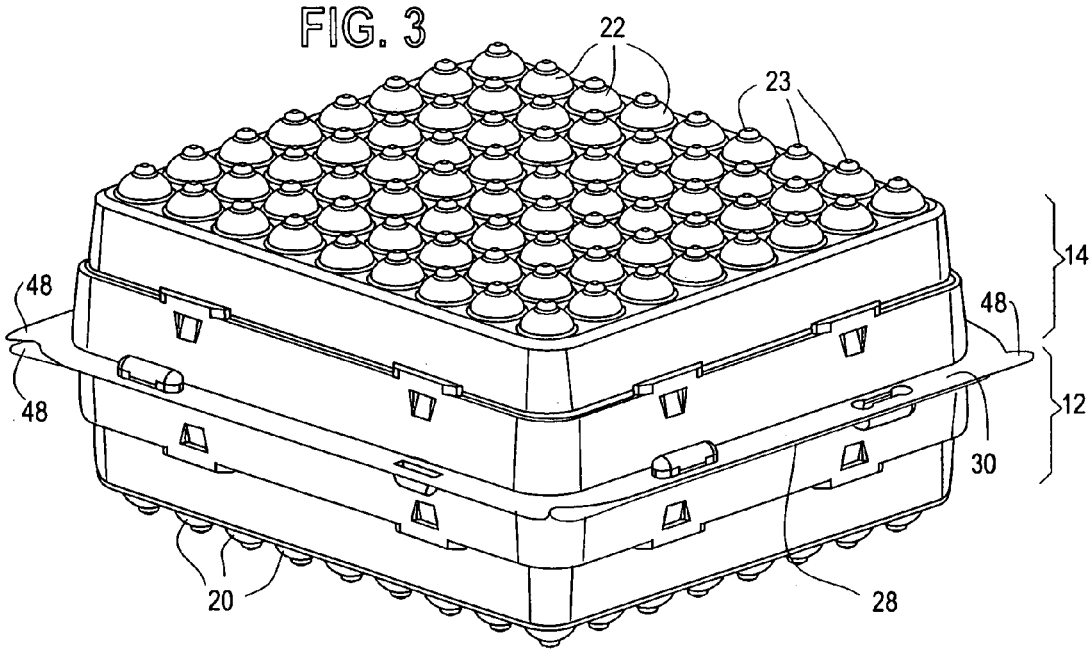
FIG. 3 is a perspective view of the first preferred embodiment of the improved test tube rack showing the tray and the cover snapped together.
Figure 4:
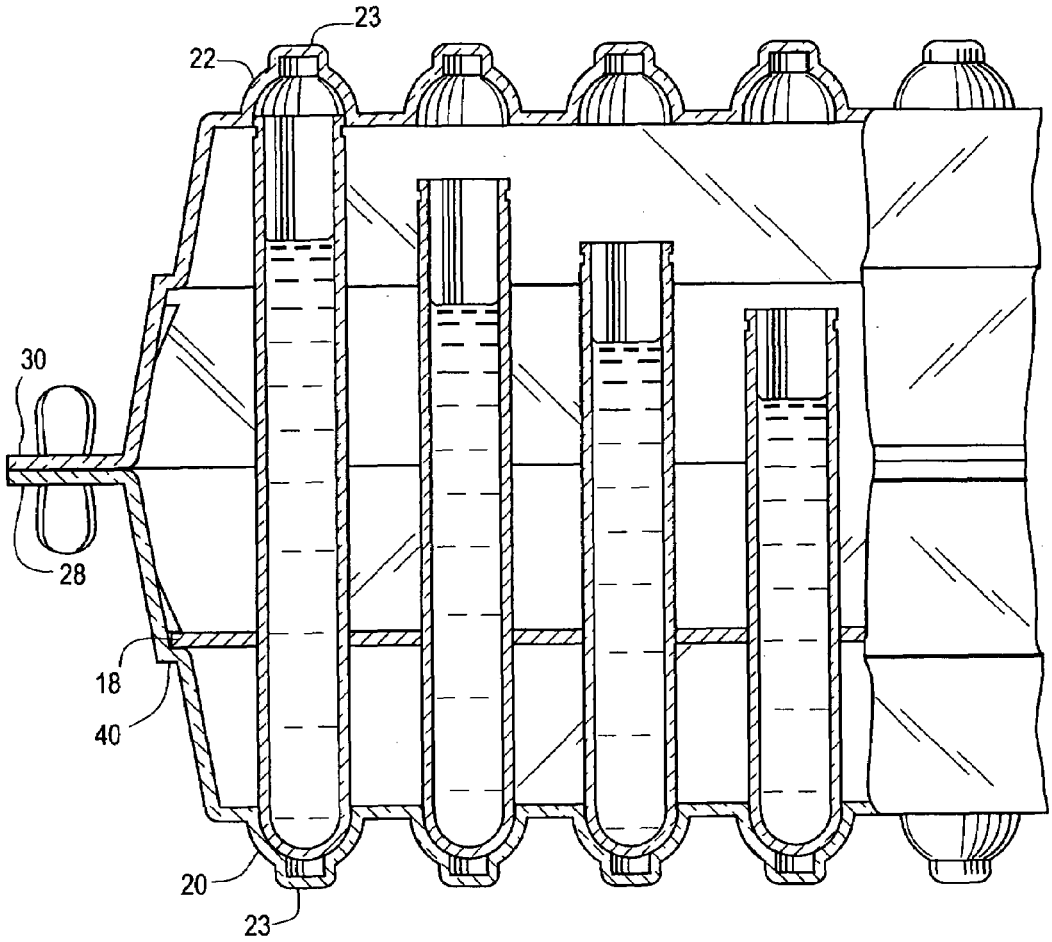
FIG. 4 is a partially broken away fragmentary side view of the first preferred embodiment showing test tubes of varying heights secured only by the lower support panel. The central support panel is not shown.
Figure 5:
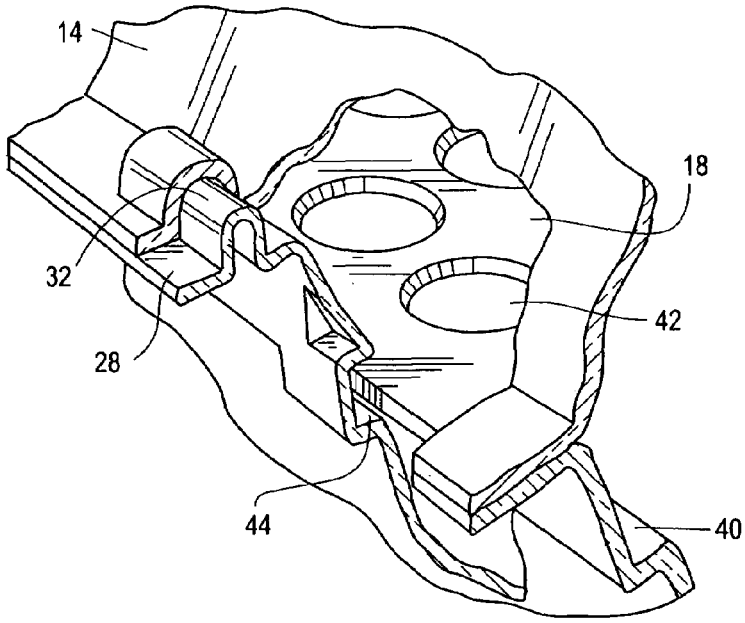
FIG. 5 is a partially broken away fragmentary perspective view of the first preferred embodiment of the improved test tube rack showing a tab and a depression functionally engaged, and the lower support panel secured on the peripheral ledge.

In the first preferred embodiment, the peripheral tray flange 28 and the peripheral cover flange 30 each have corners with a notch 48. As shown in FIG. 3, when the peripheral tray flange 28 and the peripheral cover flange 30 are facing each other and the tray 12 is snapped to the cover 14, the notch 48 on the tray 12 and the notch 48 on the cover 14 sit in opposite orientations, which provide handles to grab in order to facilitate removing the cover 14 from the tray 12.

As a further feature of the invention, some or all of the components of the improved tray are made of a transparent thermoplastic material to readily permit inspection of the tray's contents. The following plastics have been found to be suitable for this purpose: PVC (polyvinyl chloride) (utility and virgin), rPVC (recycled polyvinyl chloride), rPET (recycled polyethylene terapthalate), PS (polystyrene) and PC (polycarbonate).

A Second Preferred Embodiment

Figure 6:
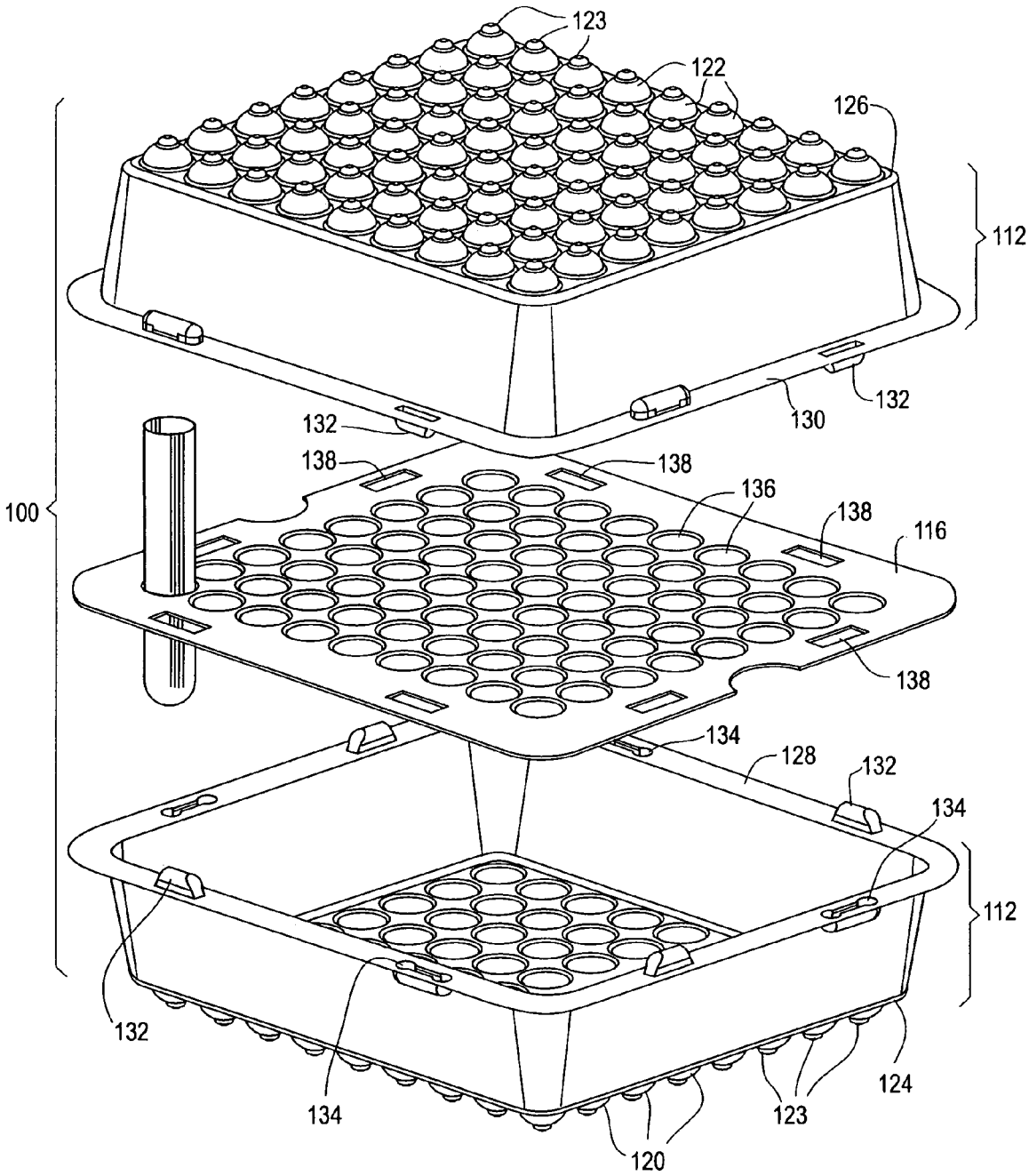
FIG. 6 is an exploded perspective view of the second preferred embodiment of the improved test tube rack utilizing a central support panel only.
Figure 7:
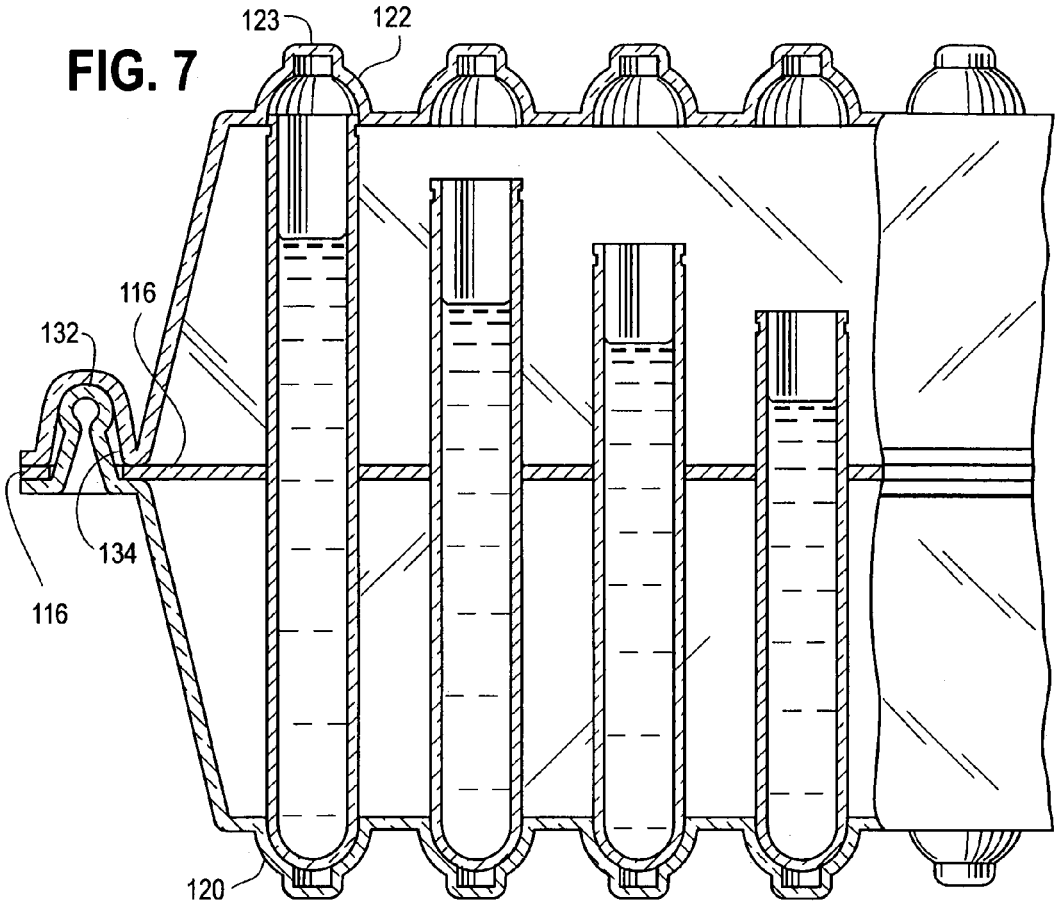
FIG. 7 is a partially broken away fragmentary side view of the second preferred embodiment showing test tubes of varying heights secured by the central support panel and also the interconnecting relationship of the tab, depression, and the central support panel.
Figure 8:
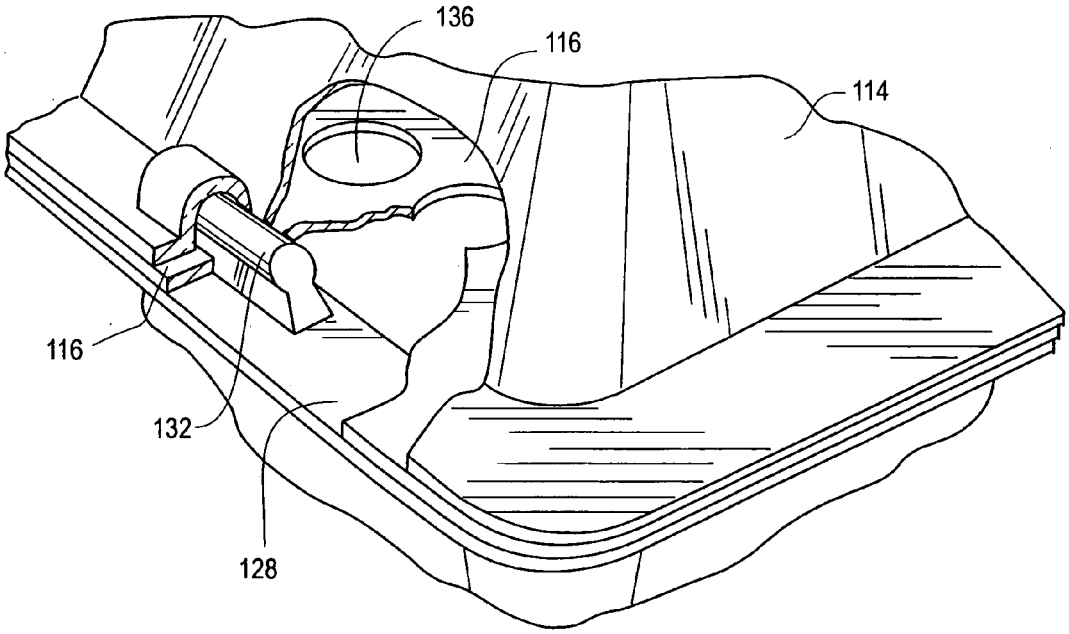
FIG. 8 is a partially broken away fragmentary perspective view of the second preferred embodiment of the improved test tube rack showing the interconnecting relationship of the tab, depression, and the central support panel.

FIGS. 6-8 show a second preferred embodiment of the improved test tube rack. FIG. 6 shows an exploded view of the three components of the this second embodiment of the improved test tube rack 100 comprising a first shell serving as a tray 112, a second shell serving as a cover 114, and the central support panel 116.

The first and second shells are identical pieces and form the tray 112 and the cover 114. The tray 112 and the cover 114 each have an array of hemispherical protrusions corresponding to the positions of the test tubes to be contained within. As a tray 112, the protrusions become wells 120 to cradle and position the test tubes. As a cover 114, the protrusions become domes 122, which fit over, and thereby position, a test tube long enough to touch at both the top of the cover 114 and the bottom of the tray 112. The wells 120 and domes 122 also have an additional protrusion forming a pocket 123 which, when the shell is a tray 112, serves to catch spilled material from the test tubes and also, on the outside of the test tube rack, to provide a cushion between the test tubes and a hard surface onto which a technician might place a filled test tube rack. The pockets 123 serve as a measure of protection against breakage of the test tubes within the test tube rack. When a tray 112 and cover 114 have been snapped together, the assembled test tube rack may be stacked on top of another assembled test tube rack by placing one on top of the other and positioning the wells 120 of the upper test tube rack on the cover top 126 between the domes of the lower test tube rack. This stackability of the test tube racks is convenient for storing assembled test tube racks on the lab bench on in the refrigerator.

According to the invention, the tray 112 and cover 114 are identical in shape, and can be formed in the same mold. The tray 112 has side walls and end walls to define a rectangular opening and also has a tray bottom 124. Each cover 114 has side walls and end walls to define a second rectangular opening and each cover 114 has a cover top 126. Because the rectangular opening of each tray 112 and cover 114 is larger than the corresponding bottom 124 or top 126, the shells have a taper, which makes them nestable, one inside the other, for compact and convenient storage.

A peripheral tray flange 128 is located around the rectangular opening of the tray 112 and a peripheral cover flange 130 is located around the second rectangular opening of the cover 114. The peripheral tray flange 128 and the peripheral cover flange 130 each include cooperating tab-and-depression positioning units. A molded-in protruding tab 132 on one side of the tray 112 is received and retained by a molded-in recessed depression 134 on the corresponding side of the cover 114, so that the tray 112 and cover 114 may be frictionally attached and retained simply by pressing them together. By forming the tabs 132 at opposite sides of the tray 112 and cover 114, and the depressions 134 at the other sides, the same shell may be used for both tray 112 and cover 114, because they will mate together exactly, not only when a tray 112 is shaped to a cover 114, but also when a tray 112 is nested within a cover 114.

The central support panel 116 contains openings 136 which are in alignment with the wells 120 in the tray 112 and the domes 122 in the cover 114 and serve to support the test tubes in the test tube rack. The central support panel 116 also has aligning openings 138 which are in alignment with the tabs 132 and the depressions 134. As shown in FIGS. 7 and 8, the tabs 132 protrude through the aligning openings 138 and align over the depressions 134 and serve to secure the central support panel 116 in place on top of the peripheral tray flange 138. When the cover 114 is added, the tabs 132 of the cover 114 protrude through the aligning openings 138 further fixing the central support panel 116 in place as the tray 114 and cover 112 frictionally lock together as described above.

Figure 9:
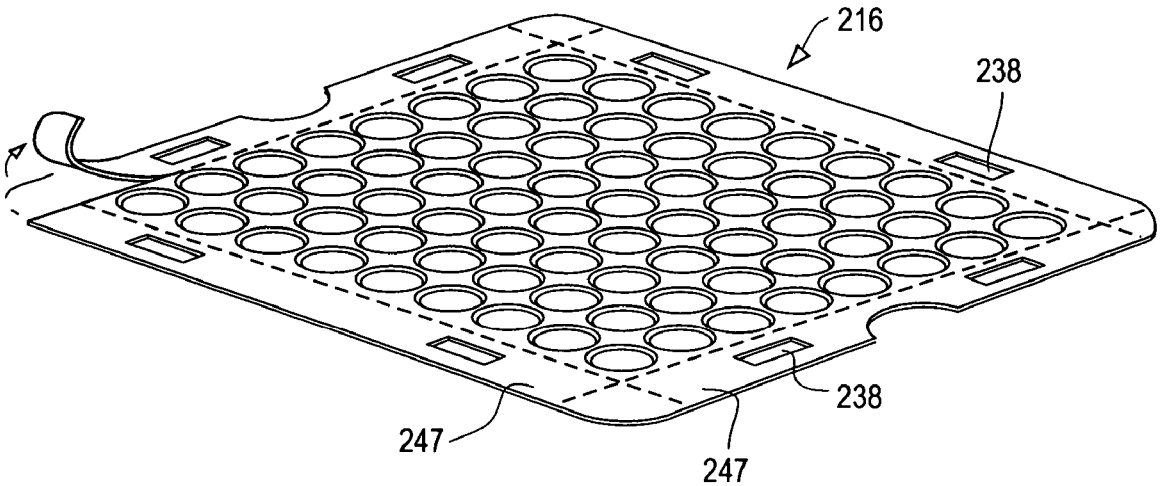
FIG. 9 is a partially broken away fragmentary perspective view of a second type of central panel for use with the first preferred embodiment, having perforated edges which may be separated by hand to reduce its size, enabling it to be used as a lower support panel.

An additional feature applicable to the first embodiment of the invention is shown in FIG. 9, which illustrates a dual-purpose support panel 216 having perforated edge strips 247 which can be easily separated by hand and removed. As supplied with the tray assembly, the support panel 216 serves the purpose of the central support panel 16 of FIG. 1, and has openings 238 adapted to engage the tabs 32 of the tray 12. By simply separating the edge strips at their perforations, the external dimensions of the separator 14 are reduced sufficiently to fit into the lower shell 12 and whereby it can rest on the ledge 40 (FIGS. 4) and serve as the lower support panel 18.

In practice, the test tube rack of the first preferred embodiment is supplied with two dual-purpose support panels 216, which at the option of the user can employed in several ways. For example, if only one support panel is required, the other can be discarded. If extra support is needed, the two support panels 216 can be superimposed and used together. Or, if both a central and lower support panel are required, one of the dual-purpose support panels 216 is reduced in size by pulling off its edge strips at their perforations (FIG. 9), enabling it to be inserted down into the tray 12 to rest on its internal peripheral ledge 40 in the manner shown in FIG. 4.

As a further feature of the invention, some or all of the components of the improved tray are made of a transparent thermoplastic material to readily permit inspection of the tray's contents. The following plastics have been found to be suitable for this purpose: PVC (polyvinyl chloride) (utility and virgin), rPVC (recycled polyvinyl chloride), rPET (recycled polyethylene terapthalate), PS (polystyrene), and PC (polycarbonate).

I claim:

1. A container for storing and retaining axially elongated articles in parallel upstanding relationship comprising:

a) a first shell forming a tray, the tray having side walls, end walls and a tray bottom, the tray side walls and tray end walls defining a rectangular opening, a peripheral tray flange located around the rectangular opening, the peripheral tray flange having first engagement means for frictionally engaging and retaining an associated cover; and the tray bottom having a plurality of wells for receiving and locating articles placed therein;

b) a second shell substantially identical to the first shell and forming the associated cover, the cover having side walls, end walls and a cover top, the cover side walls and cover end walls defining a second rectangular opening, a peripheral cover flange located around the second rectangular opening and facing the peripheral tray flange, the peripheral cover flange having second engagement means for frictionally engaging and being retained by said first engagement means; and the cover top having a plurality of domes, each of the domes being in alignment with one of the wells; and c) a central support panel between the tray and the cover, the central support panel having a plurality of support openings, each support opening being in alignment with one of the wells and one of the domes for receiving and supporting an elongated article placed therein, and having alignment openings on its periphery engageable with at least one of said first and second engagement means.

2. The container of claim 1 wherein at least one of the shells has a peripheral ledge adapted to receive a lower support panel, the lower support panel having a plurality of support openings, each support opening being in alignment with one of the wells and one of the domes for receiving and supporting an elongated article placed therein and further including nibs spaced on one side of the peripheral ledge, and grooves spaced on an opposite side of the peripheral ledge in cooperation with said nibs, said nibs and grooves being connectively engageable with said lower support panel in snap-in relationship.

3. The container of claim 1 in which the means for frictionally engaging and retaining the cover to the tray includes at least one protruding tab on one of the cover and tray, and at least one recessed depression in the other of the cover and tray, with each of said tabs being positioned to cooperate with a corresponding depression in frictional retaining engagement.

4. The container of claim 1 further including a lower support panel having a plurality of support openings, each support opening being in alignment with one of support openings of the central support panel for receiving and supporting an elongated article placed therein, and being retained within one of said first and second shells spaced from said central support panel to provide intermediate support to an elongated article placed therein.

5. The container of claim 4 in which said lower support panel is created by providing a second central support panel with perforated edges, which edges may be separated to permit its use as the lower support panel.

* * * * *